United States Patent [19]

Kleven

[11] 4,267,036

[45] May 12, 1981

[54] APPARATUS AND METHOD FOR SEPARATING FREE METAL FROM ORE

[76] Inventor: Jonny H. Kleven, P.O. Box 6979, Burbank, Calif. 91510

[21] Appl. No.: 102,232

[22] Filed: Dec. 10, 1979

[51] Int. Cl.[3] ..... B03B 5/74

[52] U.S. Cl. ..... 209/444; 209/506

[58] Field of Search ..... 209/43, 18, 196, 198–200, 209/434–436, 444, 451, 452, 479, 481, 506

[56] References Cited

U.S. PATENT DOCUMENTS

| | | | |
|---|---|---|---|
| 1,986,778 | 1/1935 | Hinkley | 209/444 |
| 4,008,152 | 2/1977 | Kleven | 209/444 |
| 4,110,206 | 8/1978 | Kleven | 209/444 X |

*Primary Examiner*—William A. Cuchinski, Jr.
*Attorney, Agent, or Firm*—Willie Krawitz

[57] ABSTRACT

A multi-step wheel is provided for separating heavy metals in the free state from their ores.

One embodiment of a separating wheel includes at least two sets of inwardly directed spiral grooves that move from the wheel periphery to a central annulus. A retaining step or ledge area is defined between each groove set for collecting or retaining ore.

In another embodiment, the separator wheel is inwardly curved with a decreasing groove depth when moving from the outer periphery to the central annulus.

Unique groove designs for the separating wheel are also disclosed.

12 Claims, 3 Drawing Figures

10
11
12
13
13a
14
14a
15
16
17
18
19
20
21
22
23
24
25
26
27
28
29
30
35
36
37
38
39
40
45
46
47
48
49
50
51
52
53
54
55
56
57
58
59
60
61
62
70
71
72
M

APPARATUS AND METHOD FOR SEPARATING FREE METAL FROM ORE

BACKGROUND OF THE INVENTION

This invention relates to a new and improved method and apparatus for separating heavy metals in the free state from their associated ores. More specifically, this invention concerns a separating wheel having a unique, multi-step separating surface which contains the function of several wheels and eliminates the expense of ancillary components usually employed in these types of separating apparatus.

One type of device employing multi-wheel separating surfaces is disclosed in my U.S. Pat. Nos. 4,008,152 and 4,110,206. These devices provide a series of single wheel separators with a separating surface comprising a series of spiral grooves which wind inwardly from the wheel periphery to a central annulus. Raw ore is fed to the wheel and is formed into a slurry which travels along the grooves and separates into a metal fraction and a light ore fraction. After at least two wheel fractionations, the metal fraction has a sufficiently high grade which enables it to be usefully processed.

While these devices perform adequately, a lighter device having fewer moving parts and fewer components would be desirable in some instances; obviously, such a device would be less expensive to manufacture. Where a single wheel separator is used, it would be easier to physically handle because of fewer controls and adjustments and ease of monitoring separating effects on the ore.

Heretofore, the basic problem in using a single wheel separator has been the necessity of reworking a batch of ore after an initial separation. This is due to the inherent separating capacity of a wheel which tends to be low because there is a limit to the amount of raw ore which it can feasibly carry. Also, it is desirable to employ narrow and shallow grooves near the center of the wheel so that the light, coarse ore will be rejected and only the heavy metal will travel along the final length of groove. However, if too much ore is applied to the wheel, these narrow grooves become overloaded, blocked, etc., and the free flow of metal is impaired.

THE INVENTION

According to the invention, a single, multi-step, downwardly inclined wheel is provided for separating metals in the free state in slurry form from their associated ores. In one embodiment, the separator comprises at least two, and typically three sets of grooved areas, each area having a plurality of inwardly directed, spiral grooves, preferably with a decreasing groove size from the periphery of the wheel to its central annulus. A stepped portion is usually disposed between each set of grooves, and provides a ledge or collecting area where light ore fractions accumulate. The light ore and any associated heavy metal are then slowly washed over the ledge and downwardly across the preceding grooves. The heavy metal gravitates to the bottom of the grooves and is again forwarded upwardly, while the light waste ore fraction is eventually washed off the wheel. The stepped portions function to accumulate ore and heavy metal and permit the ore and metal to slowly wash downwardly; this enables an improved separation of the metal from the ore as it passes over the grooves.

At least two, and preferably three or more sets of grooved areas are utilized to separate the metal from ore in a single pass across the wheel. In one embodiment, the separating wheel provides three distinct separating groove attack angles.

In another embodiment of this invention, an inwardly curved, separating wheel is provided having grooves with angles that vary continuously rather than discontinuously as in the stepped wheel.

DESCRIPTION OF THE PREFERRED EMBODIMENT

Figures 1, 2, 3:
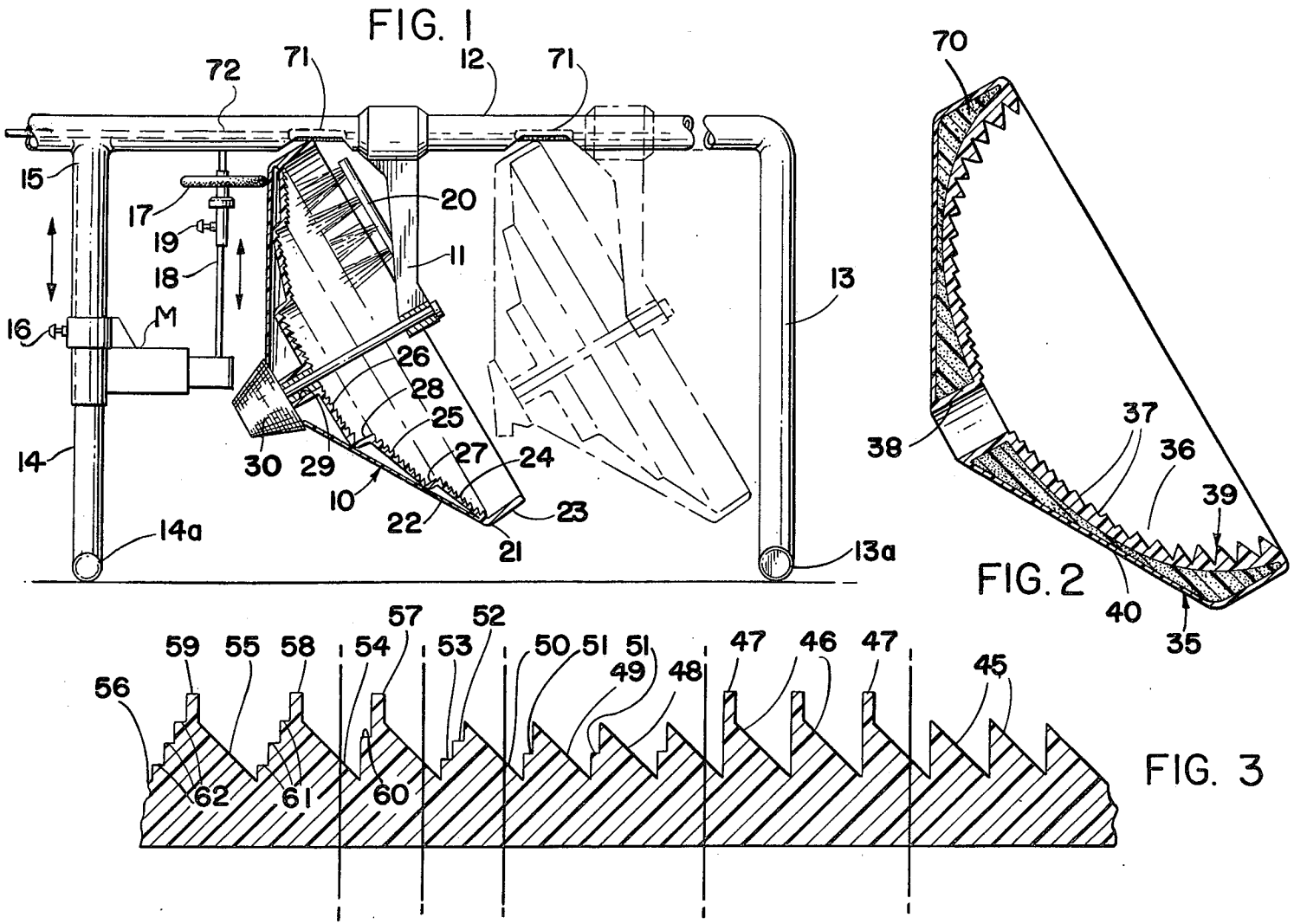
FIG. 1 is a sectional side elevation showing a separating wheel having a multi-step separating surface.
FIG. 2 is a sectional side elevation showing another embodiment of a separating wheel having a continuously curved, grooved surface for providing varying separating angles of grooves when separating metal from ore.
FIG. 3 is a view in sectional side elevation showing various groove configurations which may be utilized in the separating wheels of FIGS. 1 and 2.

One form of device incorporating a multi-step separating wheel is shown in FIG. 1. The separating wheel 10 is mounted by a bracket 11 that is suspended from a horizontal bar 12 attached at each end to pipes 13 and 14. Pipe 13 is supported by a movable T-bar 13*a*, and pipe 15 is raised or lowered along a support 14 by means of a vertically adjustable clamp 16. The horizontal bar 12 will adjust to vary the inclination of the separating wheel 10 when pipe 14 is raised or lowered, and this will accommodate varying operating conditions such as slurry concentration, ore load, particle size, etc.

A drive motor M mounted on the pipe 14 rotates a friction element 17 from a drive shaft 18. The friction element is vertically adjustable along the drive shaft by a clamp 19 and drives the separating wheel at various speeds depending on its location relative to the wheel periphery. If the friction element 17 contacts the wheel near its periphery, the slowest wheel rotation will occur, while if it contacts the wheel near the center, the separating wheel will rotate faster.

A spray bar 20 is mounted above the separating wheel and supplies water, preferably across the radius of the wheel on the upgoing side, to slurry the ore as it is fed onto the wheel. The wheel may be formed by rotation molding, casting, etc. to form a hollow plastic body 21 such as polypropylene, polyethylene, polyurethane, polyester, nylon, epoxy, rubber, etc.; fillers, reinforcing fibers, antioxidants, etc. may be incorporated into the plastic. An aluminum wheel coated (e.g. by spraying or dip coating) with an abrasive resistant material of plastic, rubber, etc., also may be used. The wheel is cup-shaped, and its bottom 22 has an even surface to make a uniform contact with the motor driven friction element 17. The periphery of the wheel provides a rim 23 for retaining ore within the wheel as it is formed into a slurry for separation by the grooves.

Three distinct sets of grooves 24, 25 and 26 are used for separating free metals from their ores. For bankrun operations, using coarse ore, the grooves should be fairly wide and deep. However, if the ore is finely ground and screened, the grooves may be very narrow and shallow, with a higher packing density to increase throughput.

For typical wheel diameters of about 0.5–10 feet, the spiral wind of the first set of grooves 24 will vary from about ¼–2 turns; the second set of grooves 25 will have a spiral wind of about 1–20 turns; and, the spiral wind of the third set of grooves 26 will be between about 2–20 turns.

The groove sets are separated from each other by retaining step or ledge areas 27,28 to collect bendficiated raw ore which is passed inwardly from the wheel rim 23 and also ore which is washed downwardly over the grooves. The wheel at its center defines a funnel type annulus 29 through which highly concentrated ore or separated free metal is passed after having been separated from the ore; typical annulus diameters vary from about 1–4 inches. For bankrun operations, a nugget screen 30 may be employed to collect large size metal particles such as gold, platinum, silver, palladium, etc.

Each set of grooves 24, 25 and 26 are inclined to the vertical when proceeding from the periphery to the annulus 29, and this arrangement improves separating efficiency. Typically, the angles of inclination to the horizontal of the groove sets 24, 25 and 26 are respectively about 120°–150°, 120°–140°, and 100°–125°. Furthermore, inclination of the wheel itself can be varied by vertical adjustment of the clamp 16. This vertical adjustment permits the angle of attack of the grooves to be varied and is usually desirable, depending on the load, type and quality of ore, wheel speed, water availability, etc. The spiral grooves in each groove set preferably have a declining pitch from the periphery to the central annulus, and the upper edge of each ridge is usually sharply angled to maintain the dressing water in the grooves and thereby minimize water overflow.

Another embodiment of a single separator wheel which may be utilized in the apparatus of this invention is shown in FIG. 2. The separator wheel 35 comprises a hollow, cast plastic material 38 having a continuously curved separating face 36 bearing spirally wound grooves 37 thereon with a decreasing depth when proceeding from the periphery to the annulus. The peripheral portion 39 of the separating face is sharply curved so as to both retain and separate a load of ore which is slurried on the wheel. Inwardly from the periphery, the separating face is steeply inclined to effect a highly efficient separation between the heavy metal and light ore. The grooves spiral inwardly from the peripheral portion 39 which leads to a container (not shown). The back portion 40 of the separating wheel is configured, as in separating wheel 10, for contact rotational drive by the friction element 17.

Various groove designs are shown in FIG. 3, and include: triangular shapes 45; grooves 46 with extenders 47; grooves 48, 49 and 50 having a single step lifter 51 and double lifter steps 52, 53; and, grooves 54, 55 and 56 having extenders 57, 58 and 59, and a single step 60 and triple steps 61, 62 respectively. The use of extenders 47, 57, 58 and 59 to the vertical portion of a groove increases the effective groove depth. Hence, rather than merely washing the ore over the grooves, the volume of slurried ore separated by the grooves is actually increased. The use of lifter steps increases the groove area and enables a better fractionation to be made of metals with different densities because the hold time of metal or upgraded ore in a groove is increased.

Typical ore bodies which may be processed by the apparatus of this invention include mine tailings, raw ore, sluice box cleanings, sewage, sand bodies such as found in rivers, in waste from sand plants, etc.

In operation, tailings or ore containing heavy metal are fed to the rotating (5–40 RPM) wheel 10 near the horizontal center line. The ore may be applied manually, or by automatic feeding systems such as a vibrator, auger, belt or bucket feed to maintain a uniform supply to the separator wheel 10. Simultaneously, water from the spray bar 20 is applied to the ore causing a slurry to be formed. Initially, the ore is retained on the wheel at its rim, and this enables it to be slurried, while heavy metal is ultimately washed to the bottom of the grooves and is carried along the grooves and ledges or steps to the annulus 29. Separated lighter ore is quickly washed downwards to the periphery of the wheel where it collects temporarily and is eventually discharged to waste.

The present invention provides an efficient apparatus for separating metal from ore as a continuous slurry in a multi-step operation while maintaining a separating efficiency of about 95%–99%. The apparatus is greatly simplified, and this enables the operator to more easily control the separation process.

Variations of my apparatus may be used without departing from the basic scope of the invention. As an example, the hollow separating wheel can be filled with, say, polyurethane foam 70 to increase rigidity and ensure the wheel shape is retained under heavy load conditions.

If desired, the separating wheel may be rotated from the rim using a rubber drive 71 powered by a shaft 72 as shown in my prior U.S. Pat. No. 4,110,206. Where necessary, the rim drive may located at the wheel underside to support the ore load. Alternatively, the wheel may be center driven as shown in my U.S. Pat. No. 4,008,152, and the drive power may be supplied by a gasoline, water turbine, or hydraulic source, etc.

Finally, additional separating wheels may be utilized in series, one such wheel being shown in dotted designation; this will improve separating efficiency of the metal from the ore, enable better fractionation of various metals from each other, and improve throughput rates, etc. When arranged in series, the wheels are aligned so that the annulus of one wheel feeds the succeeding wheel to provide a continuous slurry as the fractionation proceeds from wheel to wheel. When two or more separating wheels are employed in series, they are usually inclined with decreasing steepness to the vertical when proceeding from the initial separation wheels to the final wheel. This permits a separation of light ore fractions by the initial wheels and increases the throughput rate.

I claim:

1. An apparatus for separating free metal from ore, comprising:

a. at least one upwardly inclined, rotatable, separating wheel, providing: i. a peripheral lip for retaining ore; ii. a central annulus, the wheel being concentrically rotatable about the annulus; iii. a plurality of spiral separating grooves disposed on the upper portion of the wheel and directed from the periphery to the annulus, the separating grooves providing, in the direction of the periphery to the annulus, an increasing angle of attack to the ore being applied to the wheel; and, b. means to form a water slurry with the ore on each wheel.

2. The apparatus of claim 1, in which the wheel is cup-shaped and comprises:

i. a peripheral lip for retaining ore;

ii. a central annulus;

iii. a plurality of spiral separating grooves disposed on the cup-shaped portion of the wheel and directed from the periphery to the annulus, the separating grooves being disposed over at least two distinct areas of the wheel;

iv. a stepped portion defined between each grooved area, and adapted to retain a slurry of ore and metal thereon, the wheel being rotatable about the annulus; and, v. means to form a water slurry with the ore on each wheel.

3. The apparatus of claim 2, in which the separating wheel is adjustably inclined.

4. The apparatus of claim 2, providing three separate groove areas, each successive groove area having an angle of inclination to the horizontal of about 120°-150°, 120°-140° and 100°-125°.

5. The apparatus of claim 2 in which the said wheel is constructed of a molded plastic material.

6. The apparatus of claim 1, in which the separating wheel is inwardly curved and comprises:

i. a peripheral, grooved lip for retaining ore;

ii. a central annulus;

iii. a plurality of spiral separating grooves disposed on the curved portion of the wheel and directed from the groove lip to the annulus, the separating grooves providing a continuously increasing angle of attack in the direction of the periphery to the annulus; and, iv. means to form a water slurry with the ore on each wheel.

7. The apparatus of claim 1, in which at least one groove is provided with a lifter step.

8. The apparatus of claim 1, including at least one groove defining a vertical wall and an extender mounted thereon.

9. The apparatus of claim 1, in which the separating wheel is inwardly curved and provides a continuously increasing angle of attack in the direction of the periphery to the annulus.

10. A process for separating free metal from ore, comprising:

a. applying the ore containing the metal to at least one upwardly inclined, rotatable separating wheel, said wheel providing: i. a peripheral lip for retaining ore; ii. a central annulus, the wheel being concentrically rotatable about the annulus; iii. a plurality of spiral separating grooves disposed on the upper portion of the wheel and directed from the periphery to the annulus, the separating grooves providing, in the direction of the periphery to the annulus, an increasing angle of attack to the ore being applied to the wheel;

b. forming a water slurry with the ore on each wheel;

c. washing lighter waste ore out of the grooves and downwardly over the peripheral lip; and, d. forwarding the slurry of beneficiated ore inwardly and upwardly along the spiral grooves and out through the central annulus.

11. The process of claim 10, in which the wheel is upwardly inclined and cup-shaped and includes: i. a peripheral lip for retaining ore; ii. a central annulus; iii. a plurality of spiral separating grooves disposed on the cup-shaped portion of the wheel and directed from the periphery to the annulus, the separating grooves being disposed over at least two distinct areas of the wheel; iv. a stepped portion defined between each grooved area, and adapted to retain a slurry of ore and metal thereon; the wheel being rotatable about the annulus; and, some of the ore slurry is accumulated on a stepped portion, waste ore is washed off and downwardly from the stepped portion, and beneficiated ore is forwarded towards the annulus.

12. The method of claim 10, in which the separating wheel is inwardly curved and provides a continuously increasing angle of attack in the direction of the periphery to the annulus.

* * * * *